US006910460B2

(12) United States Patent
Asano et al.

(10) Patent No.: US 6,910,460 B2
(45) Date of Patent: Jun. 28, 2005

(54) ENGINE AIR-FUEL RATION CONTROL METHOD WITH VENTURI TYPE FUEL SUPPLY DEVICE AND FUEL CONTROL APPLIANCE INCLUDING THE METHOD

(75) Inventors: Seiji Asano, Tokyo (JP); Bunji Igarashi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/621,406

(22) Filed: Jul. 18, 2003

(65) Prior Publication Data

US 2004/0011341 A1 Jan. 22, 2004

(30) Foreign Application Priority Data

Jul. 18, 2002 (JP) ..... 2002-210009

(51) Int. Cl.[7] ..... F02D 41/08

(52) U.S. Cl. ..... 123/339.12; 123/339.16; 123/339.17; 123/339.18; 123/527; 123/438; 123/439

(58) Field of Search ..... 123/339.12, 339.16, 123/339.17, 339.18, 525, 527, 438, 439

(56) References Cited

U.S. PATENT DOCUMENTS 3,906,910 A * 9/1975 Szlaga, Jr. ..... 123/677
4,187,805 A * 2/1980 Abbey ..... 123/439
4,341,190 A * 7/1982 Ishikawa et al. ..... 123/439
4,349,877 A * 9/1982 Oyama et al. ..... 123/439
4,376,427 A * 3/1983 Mizuno ..... 123/339.12
4,422,423 A * 12/1983 Sugiyama et al. ..... 123/439
4,426,968 A * 1/1984 Onuki et al. ..... 123/339.18
4,457,279 A * 7/1984 Teramura et al. ..... 123/439
4,484,557 A * 11/1984 Matsubara ..... 123/439
4,563,990 A * 1/1986 Kishida et al. ..... 123/438
5,337,722 A * 8/1994 Kurihara et al. ..... 123/527

FOREIGN PATENT DOCUMENTS

JP 2000-018100 1/2000

* cited by examiner

*Primary Examiner*—Erick Solis
(74) *Attorney, Agent, or Firm*—Crowell & Moring LLP

(57) ABSTRACT

An object of the present invention is to maintain stable air-fuel ratio on a venturi type fuel supply device, irrespective of the external load such as air-conditioner and electrical load, and to provide stable engine speed on idling state.

A venturi type fuel supply device comprises a venturi chamber located in the upstream of a throttle valve and a passage for supplying air-fuel mixture gas into the venturi chamber. The passage is further equipped with a variable air bleeder valve for taking in air. When the operating state of the external load of the engine changes, the opening of the air bleeder valve is adjusted in accordance with the change so as to control the air-fuel mixture ratio of the mixture gas incoming from the passage into the venturi chamber.

8 Claims, 18 Drawing Sheets

ENGINE AIR-FUEL RATION CONTROL METHOD WITH VENTURI TYPE FUEL SUPPLY DEVICE AND FUEL CONTROL APPLIANCE INCLUDING THE METHOD

BACKGROUND OF THE INVENTION

1. Field of the Invention

The present invention relates to an engine air-fuel ratio control method with a venturi type fuel supply device and a fuel control appliance including the method.

2. Prior Art

An air-fuel ratio control method with a venturi type fuel supply device and a fuel control appliance including the method are well known art. For example, the Japanese Application Patent Laid-open Publication No. 2000-18100 discloses a gas fuel engine with a venturi type fuel supply device comprising a venturi chamber located in the upstream of a throttle valve and a passage for supplying fuel into the venturi chamber, wherein CNG (compressed natural gas) is used as the gas fuel. This fuel supply device comprises a 3-port solenoid valve provided on the venturi chamber side in the passage for supplying fuel, a bypass passage connecting the 3-port solenoid valve and an intake system in the downstream of the throttle valve of the engine, and a control means for switching the 3-port solenoid valve at the time of starting of the engine so as to let the gas fuel into the bypass passage. Thereby it aims to improve the startability of the engine, in particular, the startability under low temperature.

Furthermore, the fuel supply device is also provided with a sub-injector in the intake system in the downstream of the throttle valve of the engine, and at the time of acceleration of the engine, the sub-injector is turned on so as to correct the supply quantity of the gas fuel, thereby keeps the operating condition of the engine favorable.

SUMMARY OF THE INVENTION (Problems to be Solved by the Invention)

As explained above, a venturi type fuel supply device according to the prior art aims to improve the operating condition of an engine in start-up or acceleration by paying attention only to the flow rate of gas fuel at the time of start-up or acceleration. On a real vehicle equipped with the engine, however, the external load to the engine changes as the electrical switches or the like of the air-conditioner and lights of the vehicle are turned ON/OFF irrespective of whether the car is on idling or not. For example, if the air-conditioner switch is turned ON and consequently the external load is applied, required idling air flow rate (mixture air flow rate) becomes higher to keep the engine speed corresponding to the load. In the above-mentioned gas fuel engine with a venturi type fuel supply device, however, this issue is not considered and so an ignition failure may likely be caused.

By providing a bypass passage bypassing the throttle valve and also a bypass valve (ISC valve: Idle speed control valve) for controlling the flow area of the bypass passage and by adjusting the bypass valve opening, using a suitable control means, in accordance with a change in the external load, the required idling air flow rate (mixture air flow rate) can be adjusted higher or lower. However, in the case of opening the ISC valve and increasing the air quantity, the venturi chamber pressure decreases as the idling air flow rate increases because the pressure is drawn out by the downstream intake pipe pressure. If the venturi chamber pressure decreases, the gas fuel flow incoming from the fuel passage increases, thereby the air-fuel ratio becomes rich, and a "rich" ignition failure depends on the excessiveness of the ratio. Furthermore, exhaust gas results in deteriorated emission. These problems may arise not only on idling but also on non-idling.

An object of the present invention is to provide an air-fuel ratio control method of an engine with a venturi type fuel supply device and a fuel control appliance including its method, even if the external load changed, that are capable of supplying air-fuel mixture for keeping suitable engine speed corresponding to the load without changing the air-fuel ratio to a large degree, thereby minimizes a change of the engine speed and prevents ignition failure, further restrains deteriorated emission of exhaust gas.

Another object of the present invention is to restrain a driver's torque variation feeling by setting a transition processing for controlling the variation of the air-fuel ratio. Further another object is to cope with the control of the air-fuel ratio variation and the torque variation feeling by setting the transition processing time for each change in the air-fuel ratio from "rich" to "lean" and from "lean" to "rich".

(Means for Solving the Problems)

To solve these problems, in the present invention, an air-fuel ratio control method of an engine with a venturi type fuel supply device comprises, at least, a venturi chamber located in the upstream of a throttle valve and a passage for supplying air-fuel mixture gas into the venturi chamber. Wherein, basically, the passage is further equipped with a variable air bleeder valve for taking in air. And when the operating state of the external load of the engine changes, the opening of the air bleeder valve is adjusted in accordance with the change so as to control the air-fuel mixture ratio of the mixture gas incoming from the passage into the venturi chamber.

When the external load (for example, air-conditioner load and electrical load) changes, the real engine speed changes accordingly from the target engine speed and the negative pressure in the venturi chamber changes. With the above method, however, because the air bleeder valve opening is controlled in accordance with the external load change, the variation range of the air-fuel mixture ratio of the mixture gas incoming from the fuel passage into the venturi chamber can be controlled. Because of this, the present air-fuel ratio in the intake pipe of the engine can be controlled within an allowable variation range even after the change in the load in both cases where the external load increases and decreases, and consequently the engine speed variation resulting from the air-fuel ratio variation can be controlled. Thereby the present invention can prevent ignition failure and restrain deteriorated emission of exhaust gas.

Preferably, the air-fuel ratio control method is provided with two or more control variables for adjusting the air bleeder valve opening in accordance with a change in the operating state of the external load and the opening of the air bleeder valve is adjusted by switching the two or more control variables. By providing a table for these control variables, the control method of adjusting the air bleeder valve opening can be simplified.

In a preferred mode of the invention, the air-fuel ratio control method is further provided with a transition processing for adjusting the air bleeder valve opening, the opening is adjusted gradually, and the transition quantity and the transition time of the air bleeder valve on the occasion of switching from "there is no external load" (namely externally "Not loaded") to "there is an external load" (namely externally "Loaded") condition are set differently from those on the occasion of switching from externally "Loaded " to "Not loaded" condition.

With this mode, a driver's feeling of torque variation can be restrained. Besides, in an engine using gas fuel, the ignition failure limit on the "lean" side is generally higher than that on the "rich" side. For this reason, if the transition quantity and the transition time of the air bleeder valve on the occasion of switching from externally "Not loaded" to "Loaded" condition are set, for example, less than those on the occasion of switching from externally "Loaded" to "Not loaded" condition, it can cope with the control of the air-fuel ratio variation and the torque variation feeling.

In another mode of the present invention, the venturi type fuel supply device further comprises a bypass passage bypassing the throttle valve and a bypass valve (ex. ISC valve) installed in the bypass passage, the bypass valve opening is adjusted in the case of a change in the operating state of the external load, and the air bleeder valve opening is adjusted in accordance with the adjustment quantity of the bypass valve opening.

With this method, the bypass valve (ISC valve) opening is adjusted, using a suitable control means, in accordance with a change in the external load so as to adjust the required idling air flow volume (mixture air flow volume) higher or lower. And also the air bleeder valve opening is adjusted in accordance with the consequent pressure change in the venturi chamber. As a result, the variation range of the air-fuel mixture ratio of the mixture gas incoming from the fuel passage into the venturi chamber can be controlled in accordance with the required idling air flow volume (mixture air flow volume), and hence the engine speed variation resulting from the air-fuel ratio variation can be surely controlled.

The present invention also discloses a fuel control appliance including the above-mentioned air-fuel ratio control method. The fuel control appliance comprises, at least, a venturi chamber located in the upstream of a throttle valve of an engine, a passage for supplying air-fuel mixture gas into the venturi chamber, a variable air bleeder valve, installed in the passage, for taking in air, a detection means for detecting the operating state of the external load of the engine, a control means that obtains control variables for adjusting the air bleeder valve opening, when the operating state of the external load of the engine changed, based on the detected operating state of the external load, and an air bleeder valve adjustment means for adjusting the opening of the air bleeder valve in accordance with the control variables so as to control an air-fuel ratio of the mixture gas incoming from the passage into the venturi chamber.

Preferably, the control means obtains two or more control variables in accordance with the information from the detection means, and the air bleeder valve adjustment means operates by switching the two or more control variable.

In another mode of the invention, the fuel control appliance further comprises a bypass passage bypassing the bypass valve (ex. ISC valve), a bypass valve installed in the bypass passage, and a bypass valve adjustment means for adjusting the bypass valve opening based on the change of the operating state of the external load. And the air bleeder valve adjustment control means adjusts the air bleeder valve opening in accordance with the adjustment quantity of the bypass valve opening.

The operation of the fuel control appliance according to the present invention is similar to that of the aforementioned air-fuel ratio control method of the engine with the venturi type fuel supply device.

The method and appliance according to the present invention turn to be very much functional in the case of an engine using gas fuel, such as CNG, as its main fuel but they are applicable also to a gasoline engine and to an engine using both gas and gasoline by switching. Beside, an operation mode of controlling the air bleeder valve opening in accordance with a change in the external load, such as air-conditioner load and electrical load, exhibits effective function particularly in the case the engine is on idling, but, in a practical sense, it naturally can produce similar effect even on non-idling.

DETAILED DESCRIPTION OF THE INVENTION (Description of the Preferred Embodiments)

The preferred embodiments of the present invention are described hereunder, using the attached drawings. It goes without saying that the present invention is not limited to the embodiments described hereunder.

Figure 1:
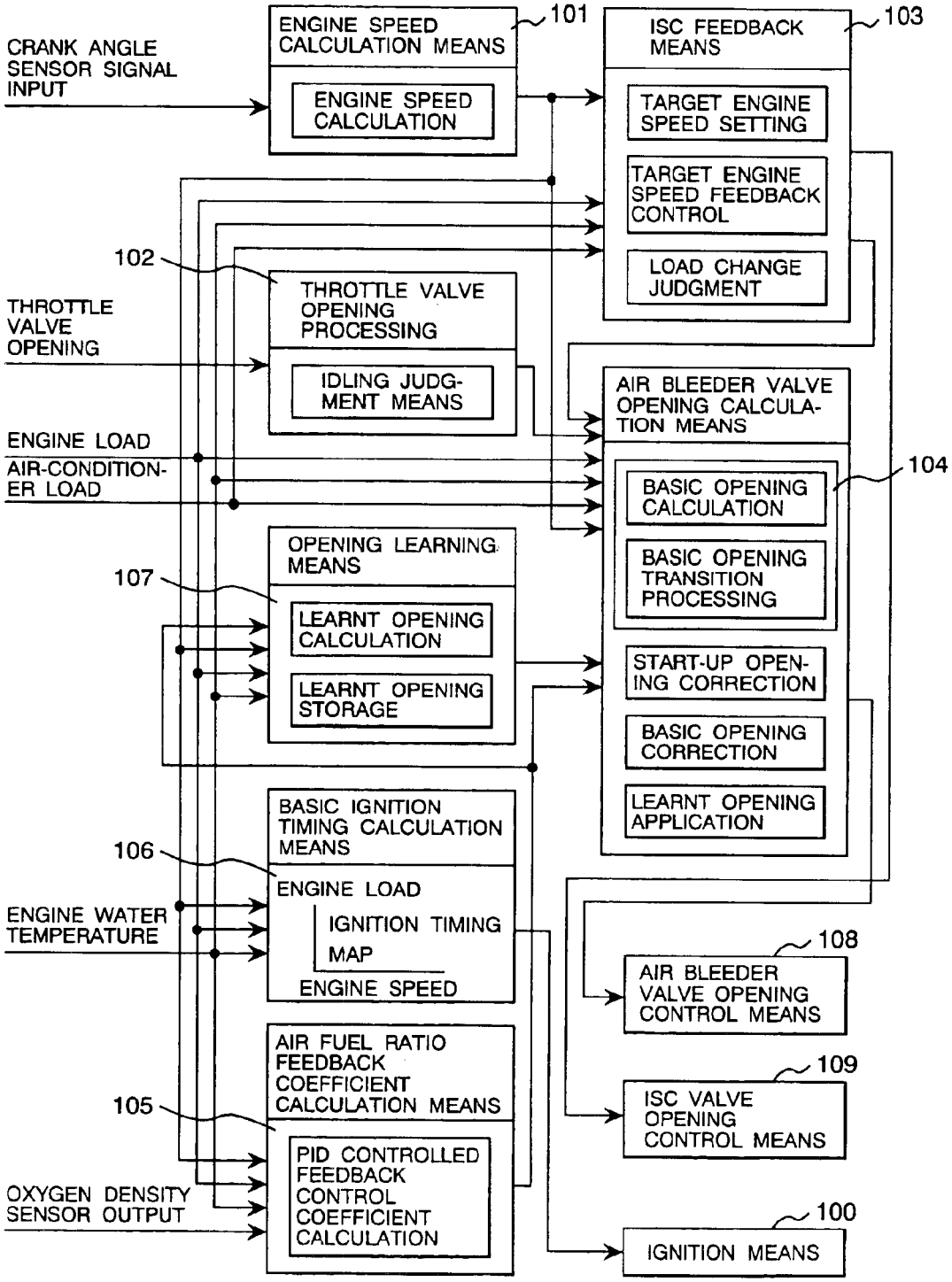
FIG. 1 is an example control block diagram of the fuel control appliance of the present invention.
Figure 2:
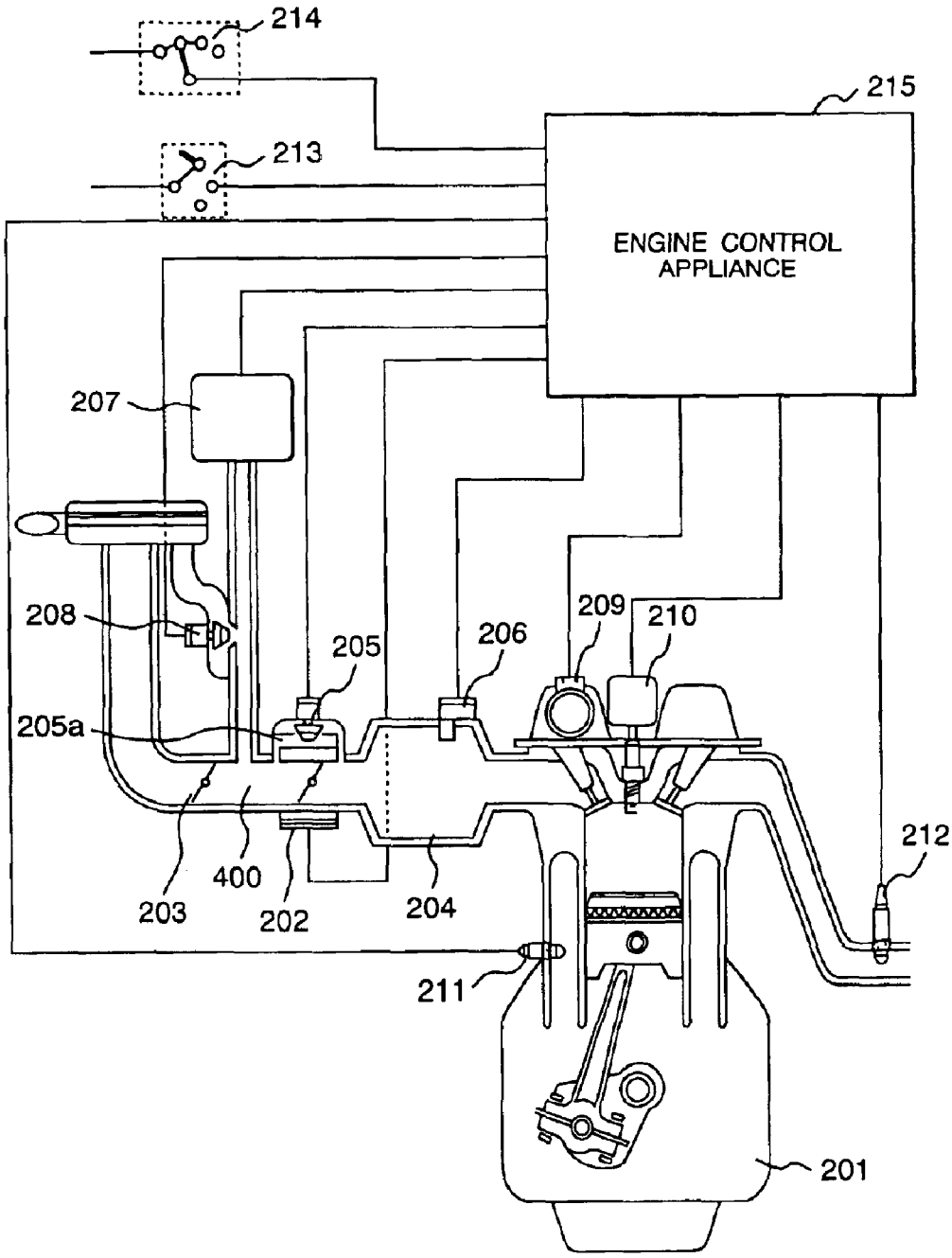
FIG. 2 is an example construction of an engine and its surroundings which the fuel control appliance of the present invention controls.

FIG. 1 is an example of a control block diagram of a fuel control appliance including the air-fuel ratio control method of a venturi type fuel supply device to which the present invention applies. FIG. 2 shows an example of a construction of an engine and its surroundings which the fuel control appliance of the present invention controls. The control blocks in FIG. 1 are explained hereunder, making reference also to FIG. 2.

In FIG. 1, a block 101 is an engine speed calculation means. The block counts and computes the electrical signals, mainly the number of inputs per unit time in the pulse signal changes from the cam (crank) angle sensor 209 installed at a specified cam (crank) angle on the engine 201 so as to calculate the engine 201 speed per unit time.

A block 102 processes the electrical signal of the opening of the throttle valve 202 and judges idling/non-idling of the engine 201.

A block 103 specifies a target engine speed of the engine 201 on idling by using the speed of the engine 201 computed in the block 101, engine load, external load such as air-conditioner load, and engine water temperature. And then the block 103 determines the opening of the ISC valve (bypass valve) 205 through feedback control so that the specified engine speed is attained. The block 103 has also a means for judging a change in the external load of the engine 201 based on a change of required air flow rate (ISCQA; ISC air quantity) of the ISC valve 205.

A block 104 is inputted the speed of the engine 201 computed by the block 101 and the pressure of an intake pipe detected, as engine load, by the pressure sensor 206 which is located in the intake pipe 204 of the engine 201. The block 104 calculates the basic opening of the air bleeder valve 208 based on the engine speed and the intake pressure so that the air-fuel ratio for the engine 201 becomes optimum in each engine driving area. With the basic opening of the air bleeder valve 208 calculated as above, the block 104 processes the basic opening transition, corrects the basic opening, corrects the feedback control correction coefficient through air-fuel ratio feedback control, learns the air-fuel ratio correction coefficient, and applies the learnt value, all of which are to be described later, and then outputs the result as the air bleeder valve opening. The block 104 is also provided with another means for correcting the opening for the start-up of the engine 201.

Using the above engine speed, above engine load, engine water temperature, and output from the oxygen density sensor 212 located in an exhaust pipe of the engine 201, a block 105 calculates the air-fuel ratio feedback control coefficient so that the air-fuel mixture gas supplied to the engine 201 is kept at the target air-fuel ratio, to be described later. The oxygen density sensor 212 shown in FIG. 2 is a type that outputs a proportional signal for the exhaust air-fuel ratio, but another type that outputs two signals from the exhaust gas, namely "rich" side signal and "lean" side signal on the basis of theoretical air-fuel ratio, is also acceptable.

A block 106 determines the optimum ignition timing in each driving area of the engine 201 by searching into a map or the like, using the above engine speed, above engine load, and engine water temperature.

A block 107 calculates a learnt opening of the air bleeder valve 208, which is correspond to a deviation from the target air-fuel ratio, by using the air-fuel ratio feedback control coefficient calculated in the block 105, and stores the calculated result as the learnt opening.

A block 108 controls the actual opening (air bleeder opening) of the air bleeder valve 208 by using the air bleeder valve opening calculated in the block 104.

A block 109 controls the actual opening of the ISC valve 205 by using the ISC valve opening determined through feedback control in the block 103.

A block 100 is an ignition means for igniting the air-fuel mixture gas incoming into the cylinder according to the ignition timing determined in the block 106. In this embodiment, the engine load is represented by the pressure of the intake pipe 204 which is measured with the pressure sensor 206. But it may be represented by the intake air flow rate let into the engine 201.

In an example construction of an engine and its surroundings shown in FIG. 2, the engine 201 and its surroundings comprise a throttle valve 202 for controlling the intake air flow rate, a choke valve 203, of which opening is adjusted by a mechanical linkage with the throttle valve, in the upstream of the throttle valve 202, a bypass passage 205*a* connected to the intake pipe 204 bypassing the throttle valve 202, an ISC valve 205 for controlling the flow area of the bypass passage and controlling the engine speed on idling, an intake pipe pressure sensor 206 for detecting the pressure in the intake pipe 204, a regulator 207 for regulating the pressure of fuel (for example, CNG) supplied to the engine 201, an air bleeder valve 208 which is located in the downstream of the regulator 207 and controls the flow area of the passage set open to the atmosphere, a cam (crank) angle sensor 209 installed at a specified position on the engine 201, an ignition module 210 for supplying ignition energy, based on the ignition signal from the engine control appliance 215, to the spark plug that ignites the air-fuel mixture gas supplied into the cylinder of the engine 201, a water temperature sensor 211, which is installed in the cylinder block of the engine 201, for detecting the cooling water temperature of the engine 201, an oxygen density sensor 212, which is installed in the exhaust pipe of the engine 201, for detecting the oxygen density in the exhaust gas, an ignition key switch 213 as the main start/stop switch of the engine, an air-conditioner switch 214 for turning ON/OFF the air-conditioner, an engine control appliance 215 for controlling the air-fuel ratio and ignition of the engine 201, an electrical load switch (not shown) for turning ON/OFF the electrical systems of the vehicle, and so on. The oxygen density sensor 212 shown in FIG. 2 is a type that outputs a proportional signal for the exhaust air-fuel ratio. But, as explained before, it is also acceptable another type that outputs two signals from the exhaust gas, such as "rich" side signal and "lean" side signal on the basis of the theoretical air-fuel ratio. Besides, in this embodiment, the fuel control is performed by detecting the pressure of the intake pipe 204, but it also is possible that the air-fuel ratio control is performed by detecting the intake air flow rate let into the engine 201.

Figure 3:
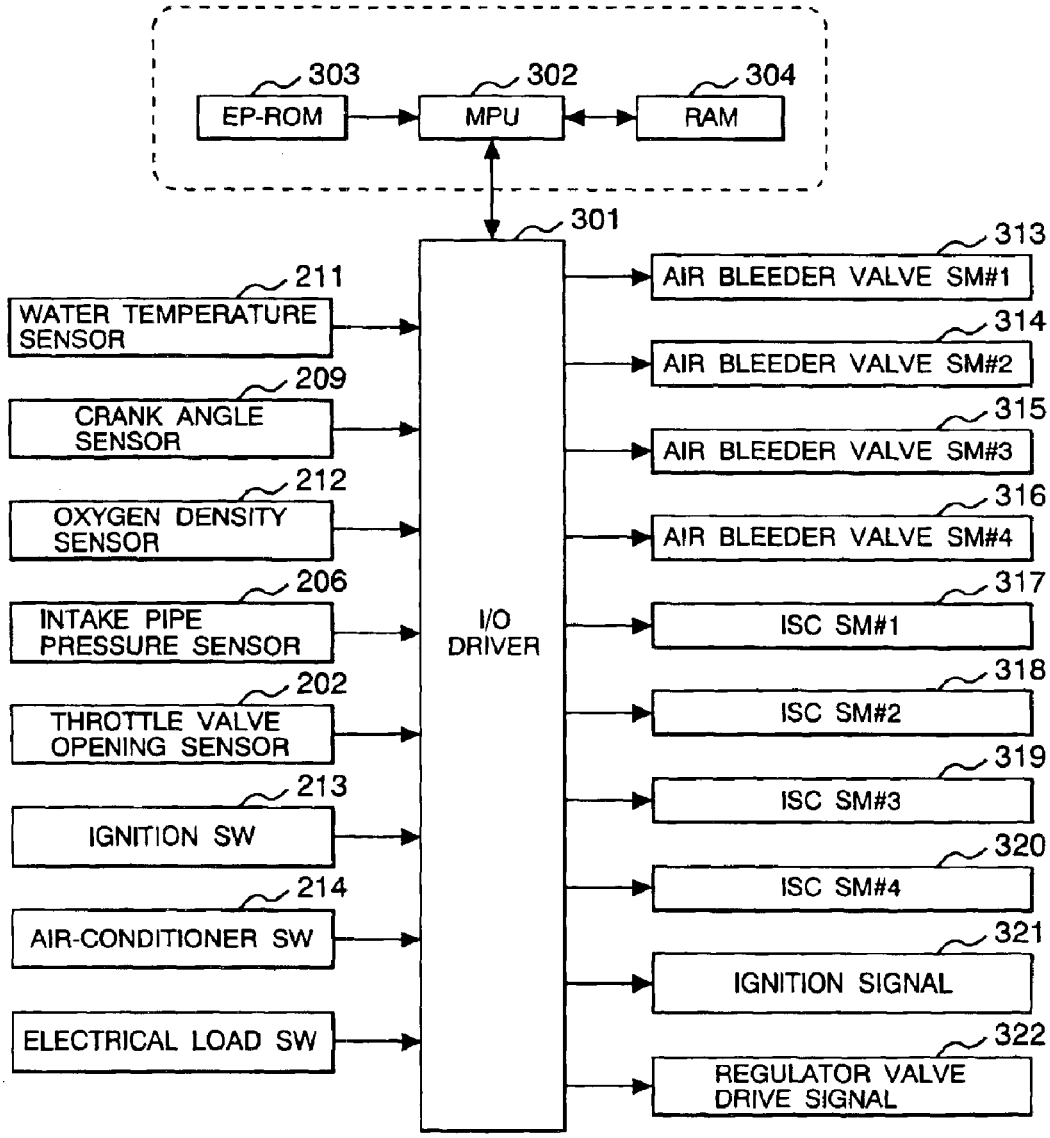
FIG. 3 is an example internal configuration of the fuel control appliance of the present invention.

FIG. 3 shows an example of the internal configuration of a fuel control appliance including the air-fuel ratio control method of a venturi type fuel supply device to which the present invention applies. The appliance comprises an I/O driver 301, a main processing unit (MPU) 302, a non-volatile memory (EP-ROM) 303, and a volatile memory (RAM) 304.

The I/O driver 301 converts the electrical signal from each sensor installed in the engine to a signal for digital computation, and also converts the control signal for digital computation to an actual actuator drive signal.

The main processing unit (MPU) 302 judges the engine condition from the digital computation signals from the I/O driver 301, and calculates the fuel quantity, ignition timing, etc. required by the engine, based on programmed procedure, and then sends the calculation result to the I/O driver 301.

The non-volatile memory (EP-ROM) 303 stores control protocols and control constants of the processing unit (MPU) 302. The volatile memory (RAM) 304 stores the calculation result of MPU 302. A backup power supply may be connected to the volatile memory (RAM) 304 so that the stored memory is held even in the case the ignition key switch 213 is OFF and no power is supplied to the fuel control appliance 215.

In this embodiment, e.g. various signals from the water temperature sensor 211, the crank angle sensor 209, the oxygen density sensor 212, the intake pipe pressure sensor 206, the throttle opening sensor 202, the ignition switch 213, the air-conditioner switch 214, and the electrical load switch are inputted to the fuel control appliance. And the opening instruction values 313 to 316 of the air bleeder valve 208, the opening instruction values 317 to 320 of the ISC valve 205, the ignition signal 321, and the valve drive signal 322 of the regulator 207 are outputted from the fuel control appliance.

Figure 4:
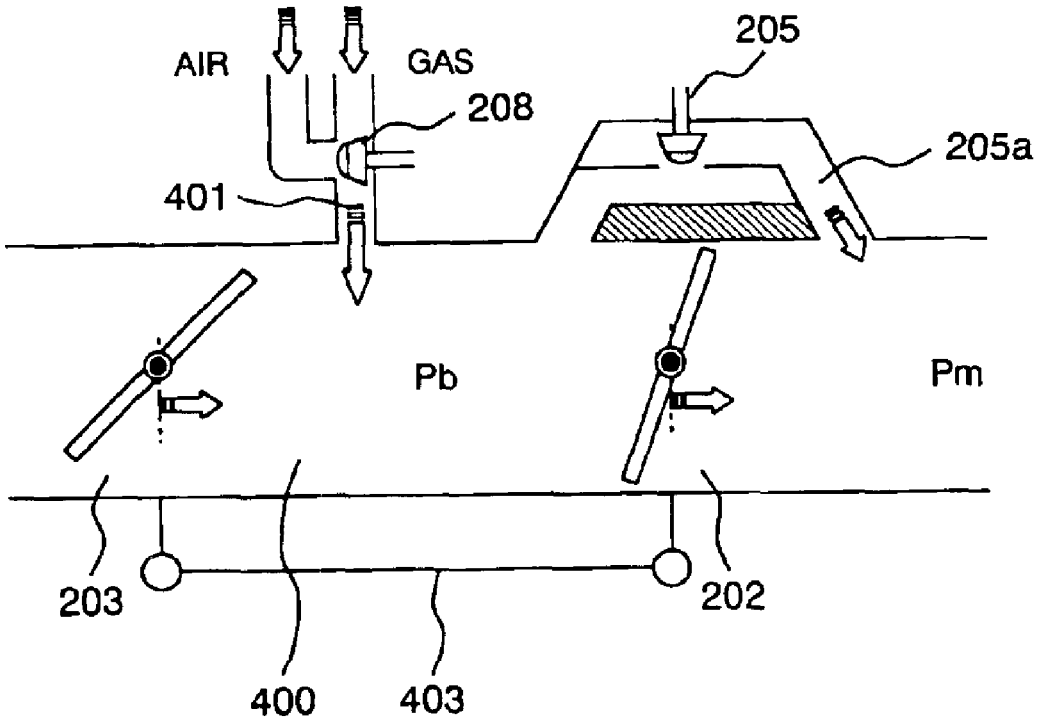
FIG. 4 is an example construction of the venturi chamber and its surroundings of the present invention.

FIG. 4 shows an example of the construction of the venturi chamber 400 and its surroundings between the choke valve 203 and the throttle valve 202 of a venturi type fuel supply device to which the present invention applies. The choke valve 203 is connected to the throttle valve 202 with a mechanical linkage 403. A passage 401, in which the air bleeder valve 208 for determining the air and fuel gas mixture ratio of the mixture gas is installed, connects to the venturi chamber 400. At the time of an idling, the mechanical linkage 403 is operated so that a negative pressure necessary for taking the mixture gas from the passage 401 is generated in the venturi chamber 400. In addition, a passage (bypass passage) 205*a*, which has the flow area controlled by the ISC valve 205, is provided bypassing the throttle valve 202. With this construction, when the ISC valve 205 is opened, the venturi pressure Pb shown in the figure decreases as it is drawn by the pressure Pm in the intake pipe 204, and accordingly the air-fuel ratio of the mixture gas incoming from the passage 401 changes even if the air bleeder valve 208 opening remains the same. The air-fuel ratio tends to become "rich" if the ISC valve 205 is opened and "lean" if it is closed. The subject matter of the present invention is to minimize the air-fuel ratio variation by controlling the opening of the air bleeder valve 208.

Figure 5:
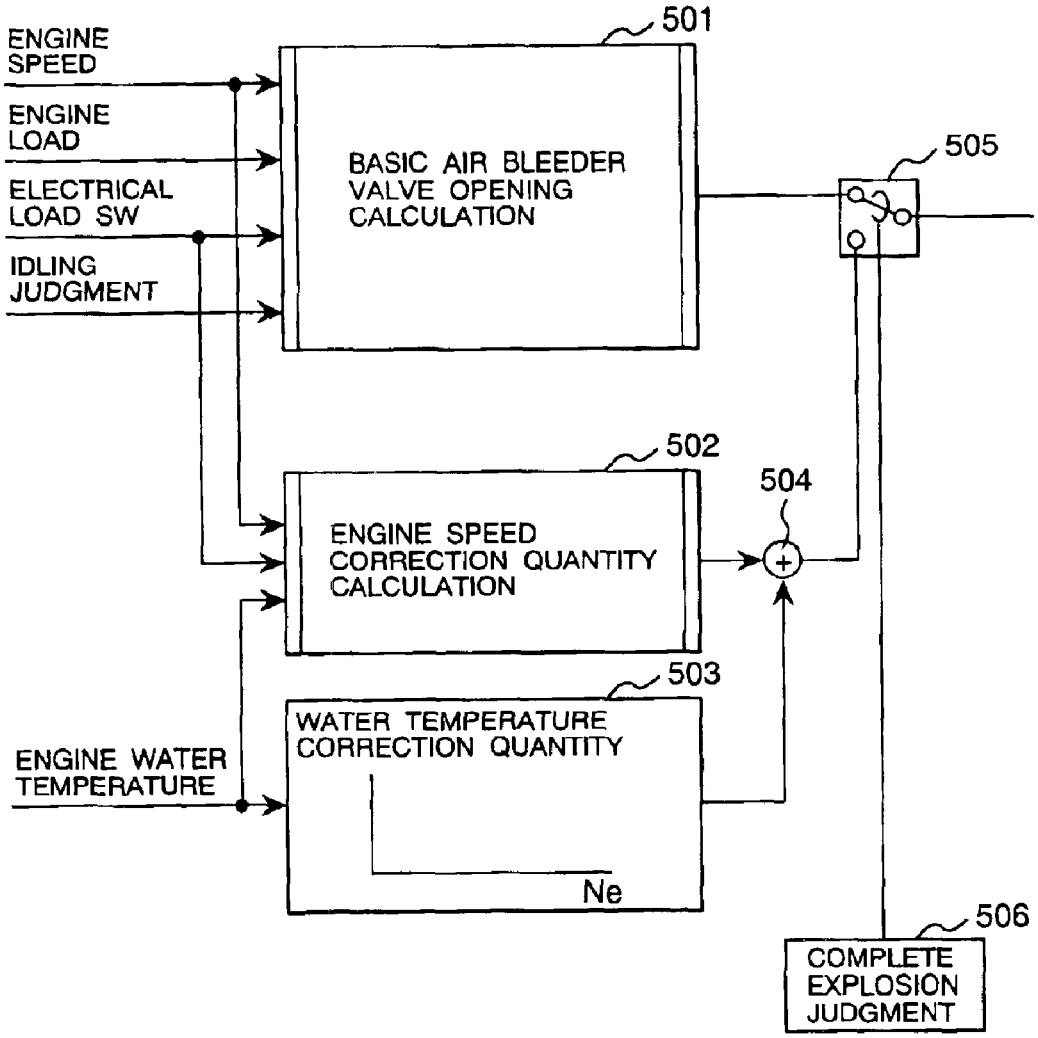
FIG. 5 is an example calculation block diagram of the air bleeder opening of the present invention.

FIG. 5 is an example of a calculation block diagram of the air bleeder opening to which the present invention applies. A block 501 calculates the basic air bleeder opening from the detected engine speed, engine load, external load such as electrical load and air-conditioner load, and idling judgment result. A block 502 calculates a correction rate of the air bleeder opening correspond to the engine speed compensation from the engine speed, external load and engine water temperature. A block 503 calculates a correction rate of the air bleeder opening correspond to the water temperature compensation from the engine water temperature. These correction rates are added in an adder 504 and calculated as the air bleeder opening before complete explosion. Either the basic air bleeder opening or the air bleeder opening before complete explosion is selected, by a switch 505, according to the complete explosion judgment in block 506, and the selected one is outputted as the air bleeder opening. In this example, complete explosion is judged from the engine speed after start-up.

Figure 6:
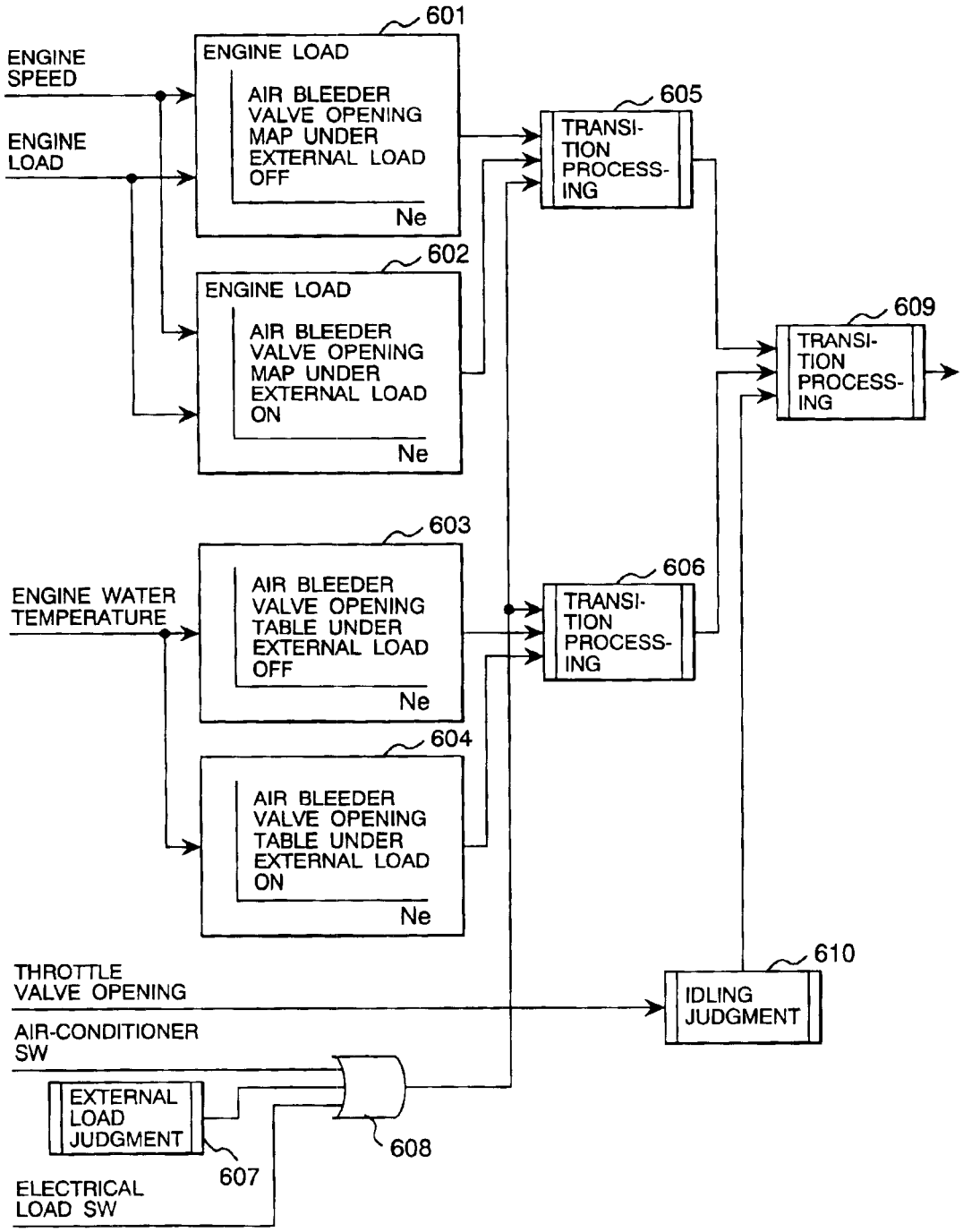
FIG. 6 is a detailed example of the basic air bleeder opening calculation block of the present invention.

FIG. 6 is a detailed example of the basic air bleeder opening calculation block 501 shown in FIG. 5. Each block 601 and 602 is a map for searching the basic air bleeder opening on non-idling. A block 601 is a map to be used when the external load is judged OFF, and a block 602 is a map to be used when the external load is judged ON. The air bleeder opening is searched in each map, using the engine speed and engine load. Each block 603 and 604 is a table for searching the basic air bleeder opening on idling. A block 603 is a table to be used when the external load is judged OFF, and a block 604 is a table to be used when the external load is judged ON. The air bleeder opening is searched in each table 603 and 604, using the engine water temperature. Each block 605 and 606 is for transition processing that is necessitated when the maps or tables are changed over depending upon the external load ON/OFF. The external load ON/OFF judgment is made, based on the load judgment value in block 607, the air conditioner switch and the electrical load switch. In this embodiment, the external load is judged ON by using an OR circuit in block 608,if any one of the load judgment value, air-conditioner switch and electrical load switch is ON (the load judgment value is "loaded"). The transition processing to be necessitated in changing over idling/non-idling each other is performed in a block 609. The idling/non-idling judgment is processed in a block 610, using the throttle valve opening. The air bleeder opening processed in block 609 is outputted as the basic air bleeder opening. The basic air bleeder opening is changed over between two maps, depending upon the external load ON/OFF, in this embodiment, but another map based on different factor may be added.

Figure 7:
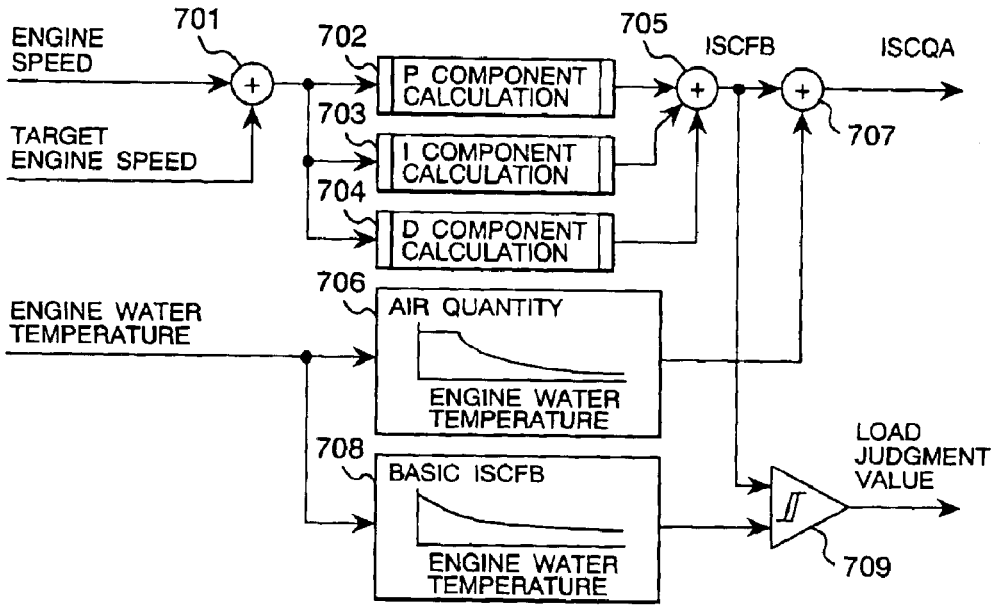
FIG. 7 is adetailed example of the load judgment block of the present invention.

FIG. 7 is a detailed example of the load judgment block 607 shown in FIG. 6. The differentiator 701 calculates the difference between the present engine speed and target engine speed. Based on the difference, the feedback control variables of the required ISC air quantity (ISCQA) are calculated in blocks 702, 703 and 704. A block 702 calculates a P component of the feedback control, a block 703 calculates an I component, block 704 calculates a D component, and the adder in block 705 adds up the P component, I component and D component, the result of which is the feedback control variable ISCFB. A block 706 is for searching the basic quantity of the ISC air quantity (ISCQA) by using a table. The basic quantity is searched into the table, using the engine water temperature. The basic quantity searched in block 706 is added to the feedback control variable (ISCFB) in the adder 707 and outputted as the ISC air quantity (ISCQA). A block 708 is for searching the basic feedback control variable. It is searched in a similar manner as for above basic quantity by using the engine water temperature. The basic feedback control variable searched in block 708 is compared with the feedback control variable ISCFB in the comparator 709, and, if the feedback control variable ISCFB is greater, a load judgment value meaning "Loaded" is outputted to the block 608.

Figure 8:
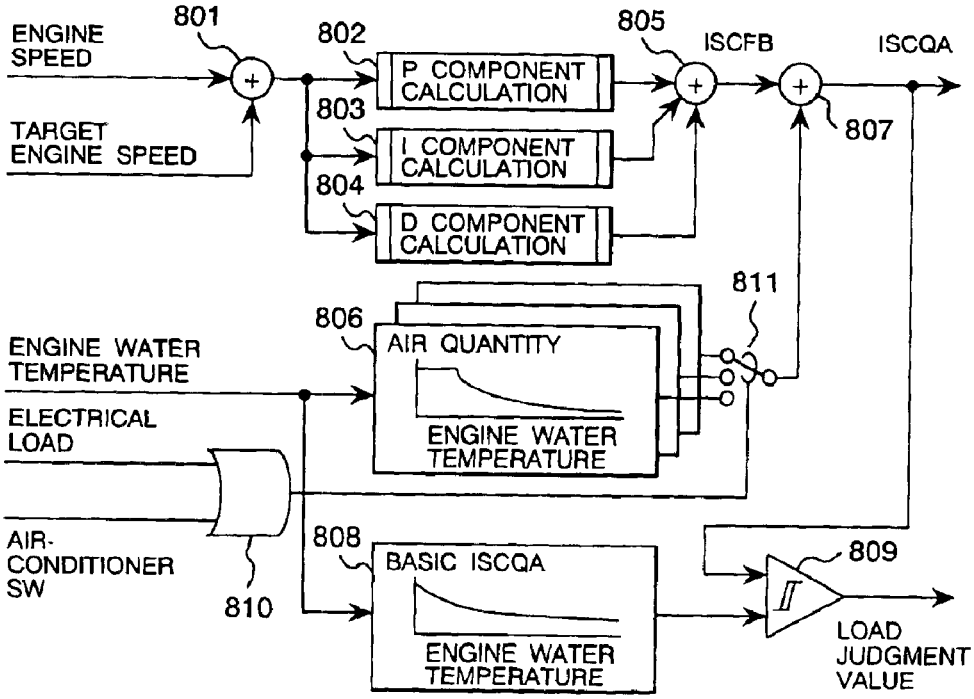
FIG. 8 is another detailed example of the load judgment block of the present invention.

FIG. 8 is another detailed example of the load judgment block shown in FIG. 6. It differs from the example in FIG. 7 in a point that multiple tables are provided for searching the basic quantity of the ISC air quantity (ISCQA) in a block 806. The multiple tables are changed over each other by a switch 811 if either the electrical load or the air-conditioner switch signal is inputted through the OR circuit in a block 810. In a block 808, the basic ISC air quantity (ISCQA) is searched, using the engine water temperature, and the result is compared with the ISC air quantity (ISCQA) in the comparator 809. If the ISC air quantity (ISCQA) is greater than the basic ISCQA, a load judgment value meaning "Loaded" is outputted.

Figure 9:
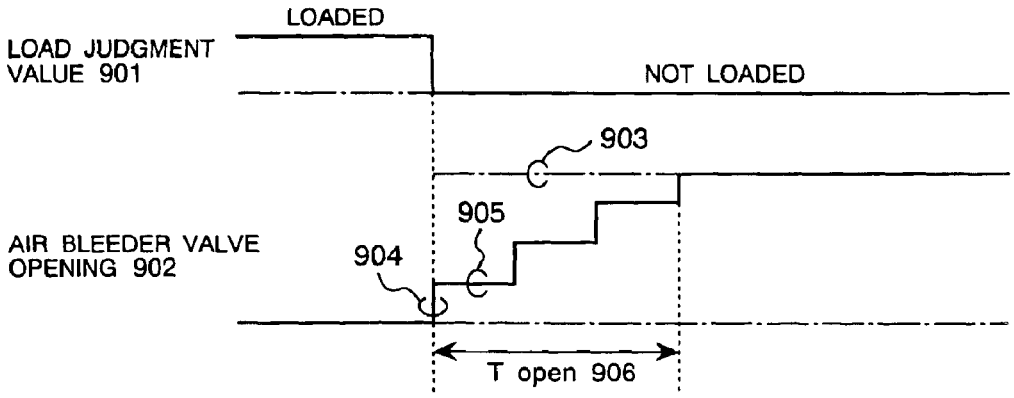
FIG. 9 is an example chart of the transition processing of the air bleeder opening of the present invention.
Figure 10:
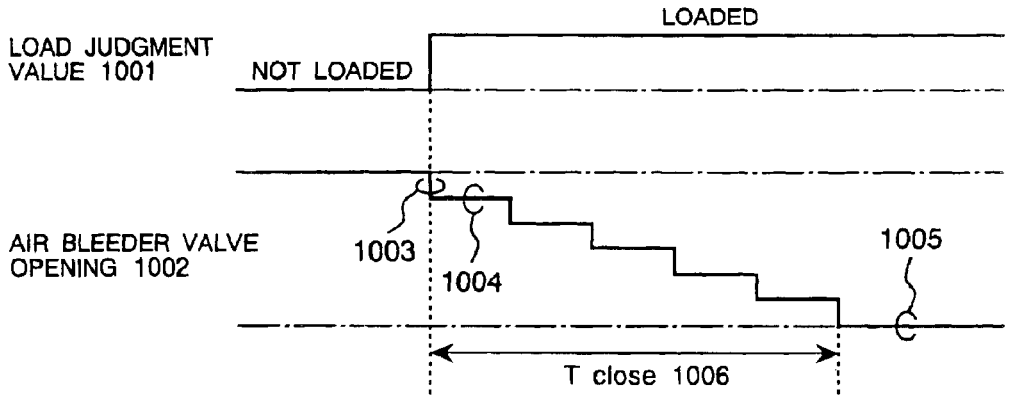
FIG. 10 is another example chart of the transition processing of the air bleeder opening of the present invention.

FIG. 9 is an example chart of the transition processing of the air bleeder opening to which the present invention applies. When the condition changes from "Loaded (there is an external load)" to "Not loaded (there is no external load)" in chart 901, the air bleeder opening shown in chart 902 converges to the final ultimate opening 903 with the passing of an attenuation quantity 904 and an attenuation time 905. The convergence time 906 up to the final ultimate opening 903 is $T_{open}$. FIG. 10 is another example chart of the transition processing of the air bleeder opening to which the present invention applies. While FIG. 9 shows an occasion of changing from "Loaded" to "Not loaded" condition, this example shows an occasion of changing from "Not loaded" to "Loaded" condition. When the condition changes from "Not loaded" to "Loaded" in chart 1001, the opening converges to the final ultimate opening 1005 in a time $T_{close}$ 1006, in a similar manner as in the example in FIG. 9. This convergence time to the final ultimate opening and that of the example in FIG. 9 have a relationship expressed by Formula (1) below.

$$T_{open} \leqq T_{close} \quad (1)$$

That is, the convergence time up to ultimate opened position of the air bleeder valve is set shorter than that up to ultimate closed position. The attenuation (convergence) time and attenuation quantity, however, can be set freely depending upon the operating condition of the engine.

Figure 11:
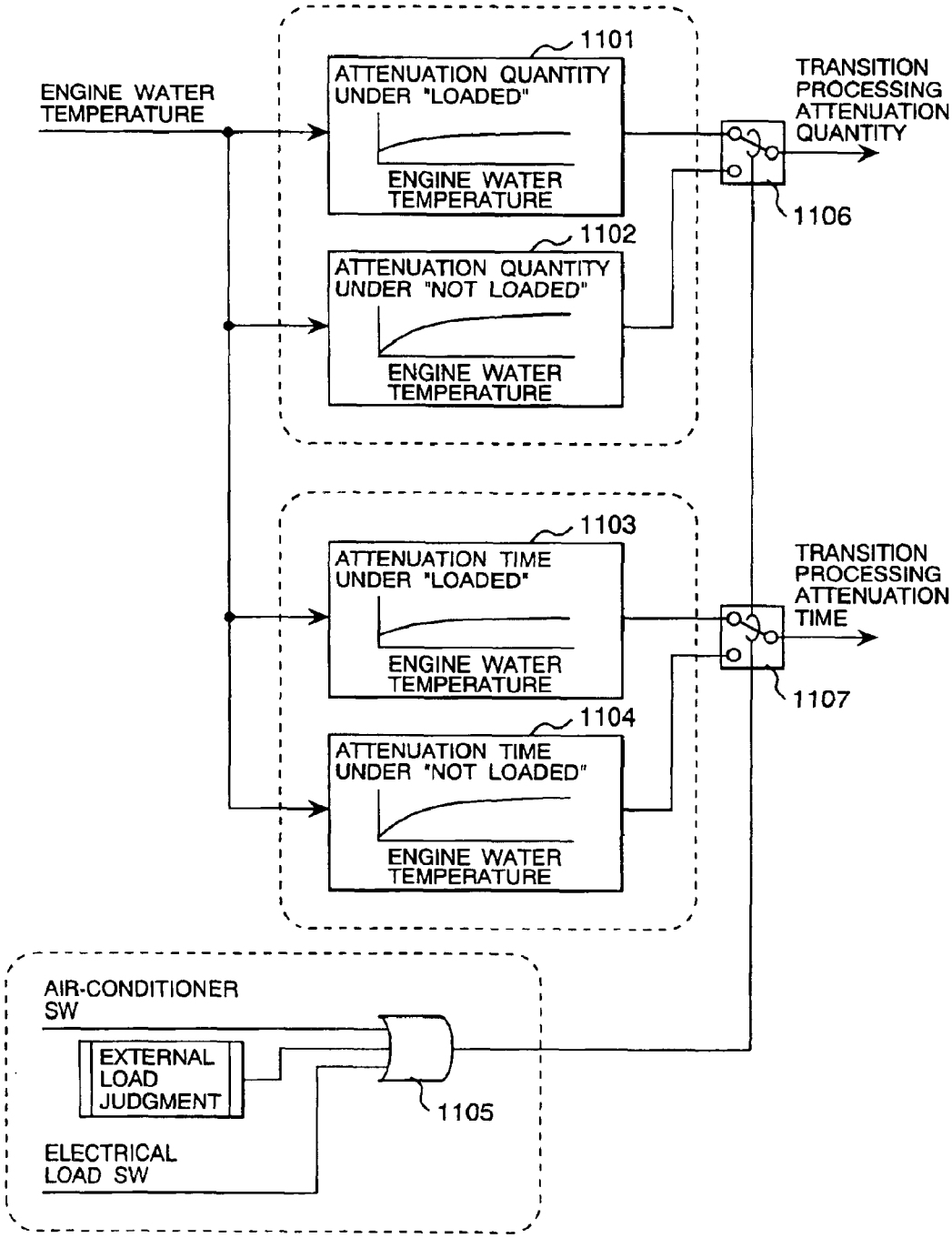
FIG. 11 is an example block diagram for setting the attenuation quantity and attenuation time for the transition processing of the present invention.

FIG. 11 is an example block diagram for setting the attenuation quantity and the attenuation time for the transition processing in FIG. 9 and FIG. 10. Each block 1101 and block 1102 determines the attenuation quantity for the transition processing by using table search. Block 1101 searches the attenuation quantity under "Loaded (there is an external load)" condition and block 1102 searches the attenuation quantity under "Not loaded (there is no external load)" condition into respective tables, using the engine water temperature. Each block 1103 and 1104 determines the attenuation time for the transition processing by using table search. A block 1103 searches the attenuation time under "Loaded (there is an external load)" condition and block 1104 searches the attenuation time under externally "Not loaded (there is no external load)" condition into respective tables, in a similar manner as for the attenuation quantity, using the engine water temperature. The air-conditioner switch signal, load judgment value from the load judgment block, and electrical load switch signal are inputted into the OR circuit in block 1105, and the attenuation quantity and attenuation time under each externally "Loaded"/"Not loaded" condition is changed over by switches 1106 and 1107.

Figure 12:
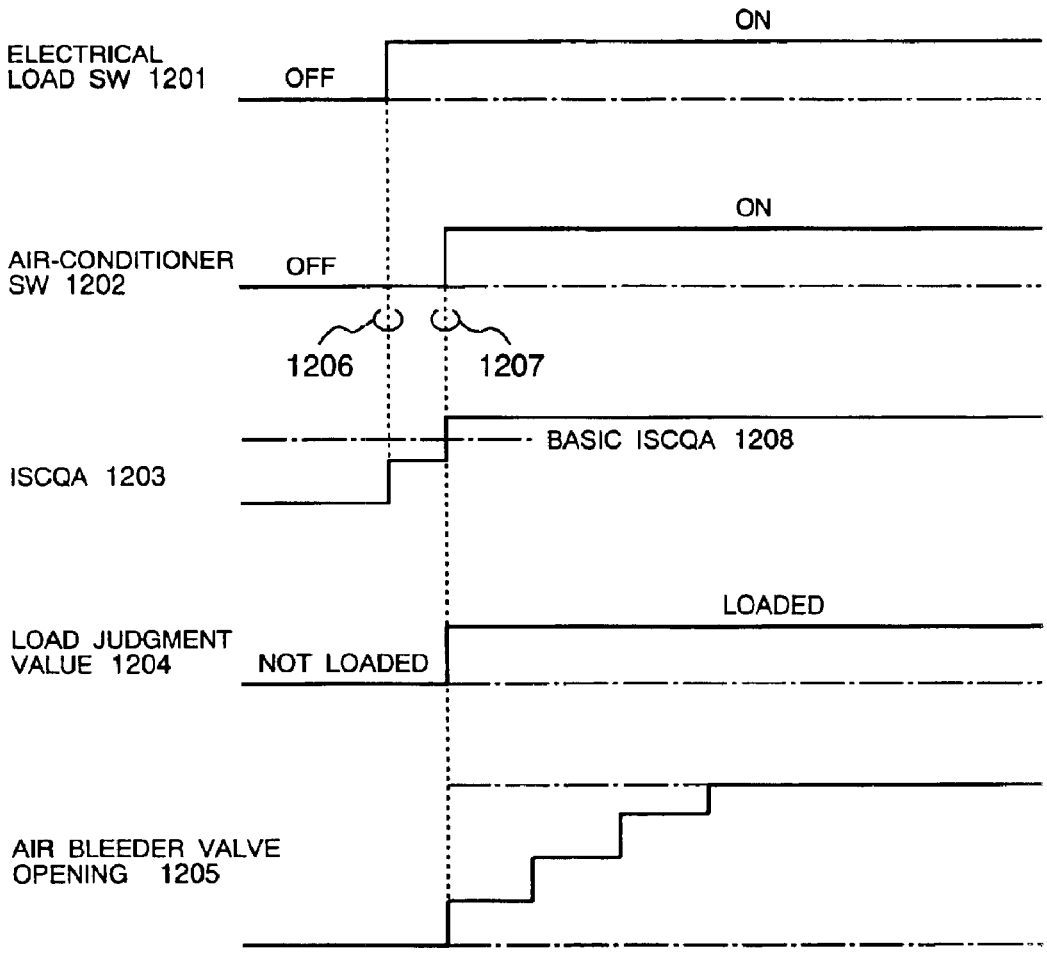
FIG. 12 is an example operation chart of the air bleeder opening to which the present invention applies.

FIG. 12 is an example operation chart of the air bleeder opening to which the present invention applies. A chart 1201 represents the electrical load switch, a chart 1202 represents the air-conditioner switch, a chart 1203 represents the ISCQA, a chart 1204 represents the load judgment value, and a chart 1205 represent the air bleeder opening. Even when the electrical load switch is turned ON at the timing 1206 and ISCQA in chart 1203 increases, the load judgment value in chart 1204 makes a judgment of externally "Not loaded" because the ISCQA does not exceeds the basic ISCQA 1208. As the air-conditioner switch is turned ON at the timing 1207, the ISCQA in chart 1203 further increases and exceeds the basic ISCQA 1208. As a result, the load judgment value changes a judgment from externally "Not loaded" to "Loaded" and the transition processing of the air bleeder opening in chart 1205 begins.

Figure 13:
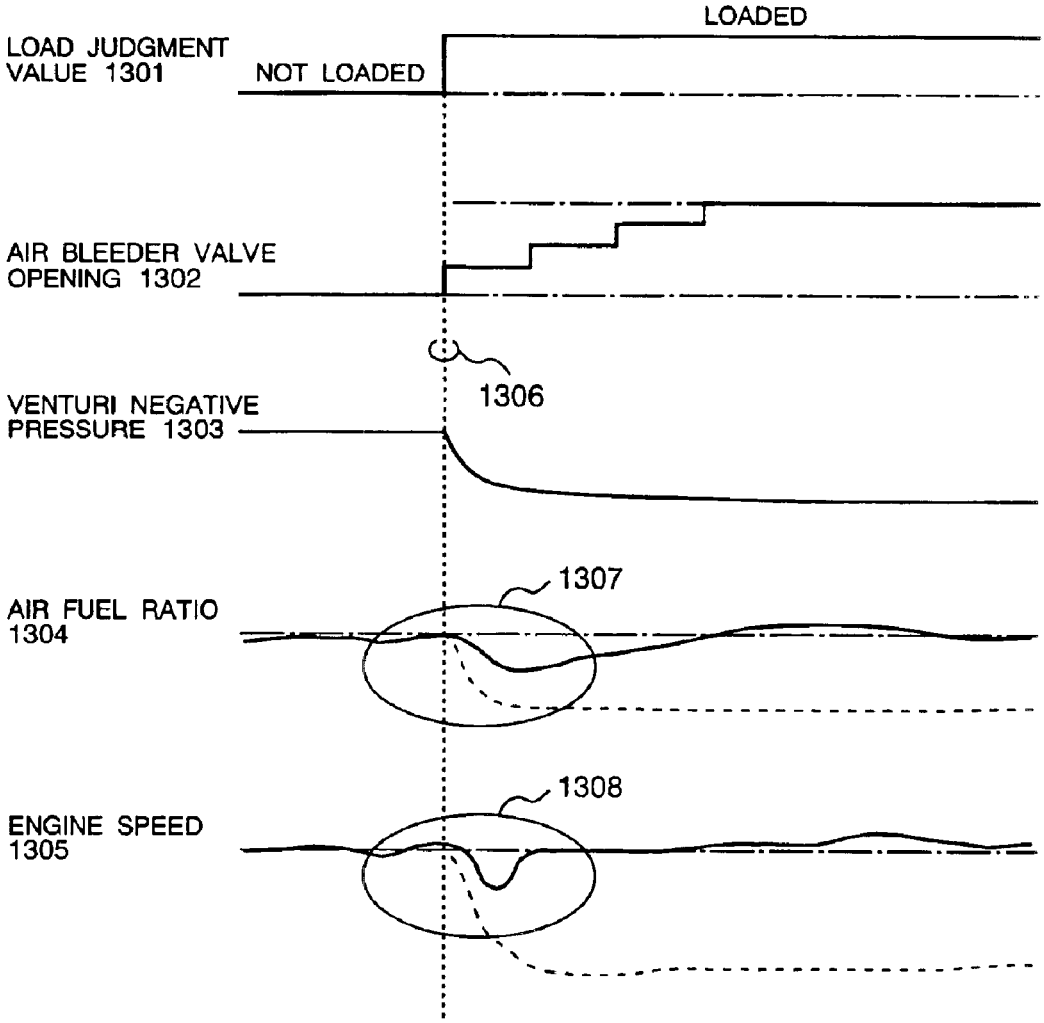
FIG. 13 is an example chart of the engine speed and air-fuel ratio behavior of the present invention.

FIG. 13 is an example chart of the engine speed and air-fuel ratio behavior in a venturi type fuel supply device including the air-fuel control method to which the present invention applies. A chart 1301 represents the load judgment value, a chart 1302 represents the air bleeder opening, a chart 1303 represents the negative pressure (Pb) in the venturi chamber 400, a chart 1304 represents air-fuel ratio, and a chart 1305 represents the engine speed. This embodiment is an example where the external load such as air-conditioner is applied and the ISCQA increases, and consequently the load judgment value is given a judgment of externally "Loaded". Because the ISCQA increases (the ISC valve 205 is made open), the venturi negative pressure (Pb) in chart 1303 becomes lower than the condition of "Not loaded". In this case, the transition processing of the air bleeder opening in chart 1402 is performed from the closed position side to the opened position side. Because of this, in the area shown in chart 1304, the air-fuel ratio variation shown by a solid line, which represents a case where the air bleeder opening changeover and attenuation processing of the present invention are applied, is smaller on the "rich" side than that shown by a dotted line which represents a case where the above are not applied. For the same reason, the engine speed in chart 1305 shown by a dotted line, which represents a case where the present invention is not applied, has decreased due to "rich" ignition failure in the area 1308, but that shown by a solid line, which represents a case where the present invention is applied, does not decrease.

Figure 14:
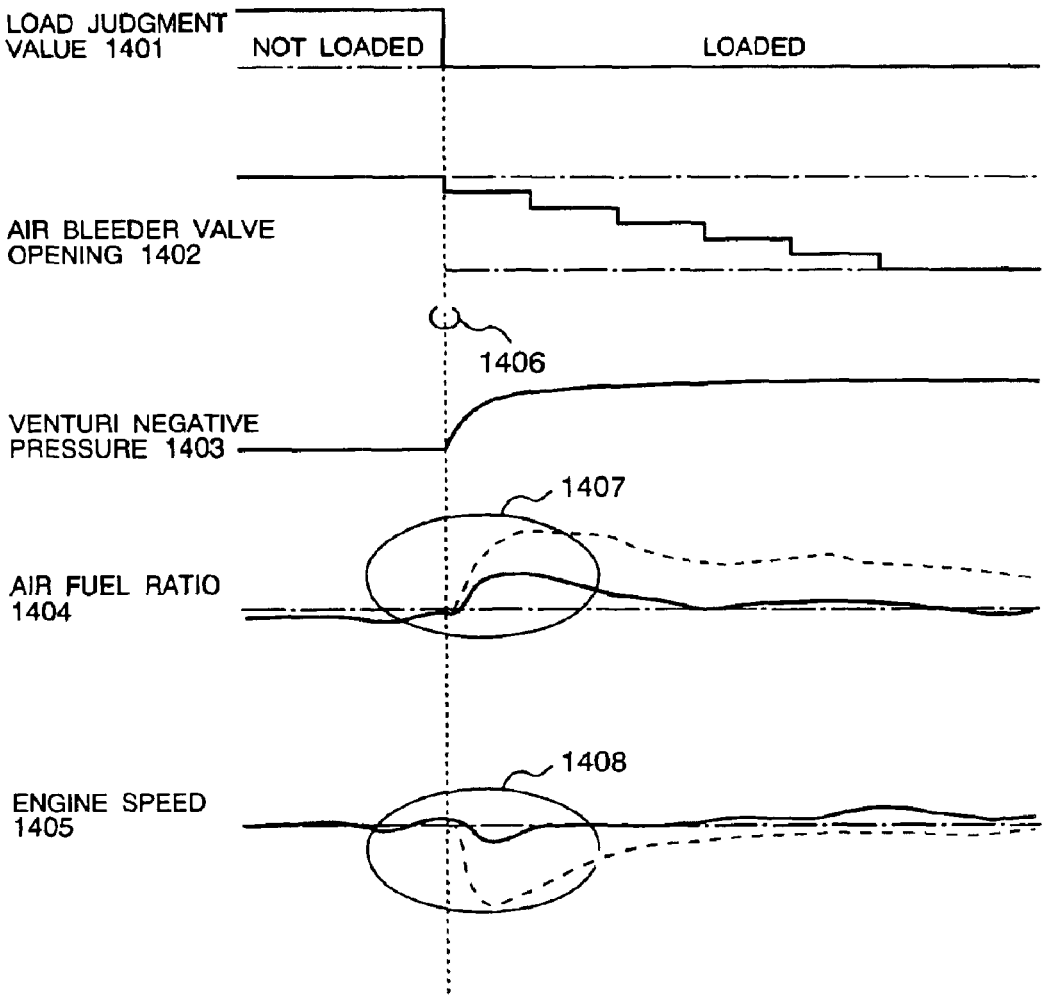
FIG. 14 is another example chart of the engine speed and air-fuel ratio behavior of the present invention.

FIG. 14 is another example chart of the engine speed and air-fuel ratio behavior in a venturi type fuel supply device including the air-fuel control method to which the present invention applies. This chart differs from the chart in the previous FIG. 13 in a point that this shows a case where the external such as air-conditioner is turned OFF. In this case, the transition processing of the air bleeder opening in chart 1402 is performed from the opened position side to the closed position side. The air-fuel ratio in chart 1404 shown by a dotted line, which represents a case where the present invention is not applied, exhibits a big variation on the "lean" side. On the other hand, a gas fuel engine according to the present invention has higher ignition failure limit on the "lean" side than on the "rich" side. Because of this, even in the case shown by a dotted line to which the present invention is not applied, the engine can recover from decreased revolution due to ignition failure as shown in the area 1408 although the convergence time is longer than the case in FIG. 13.

Figure 15:
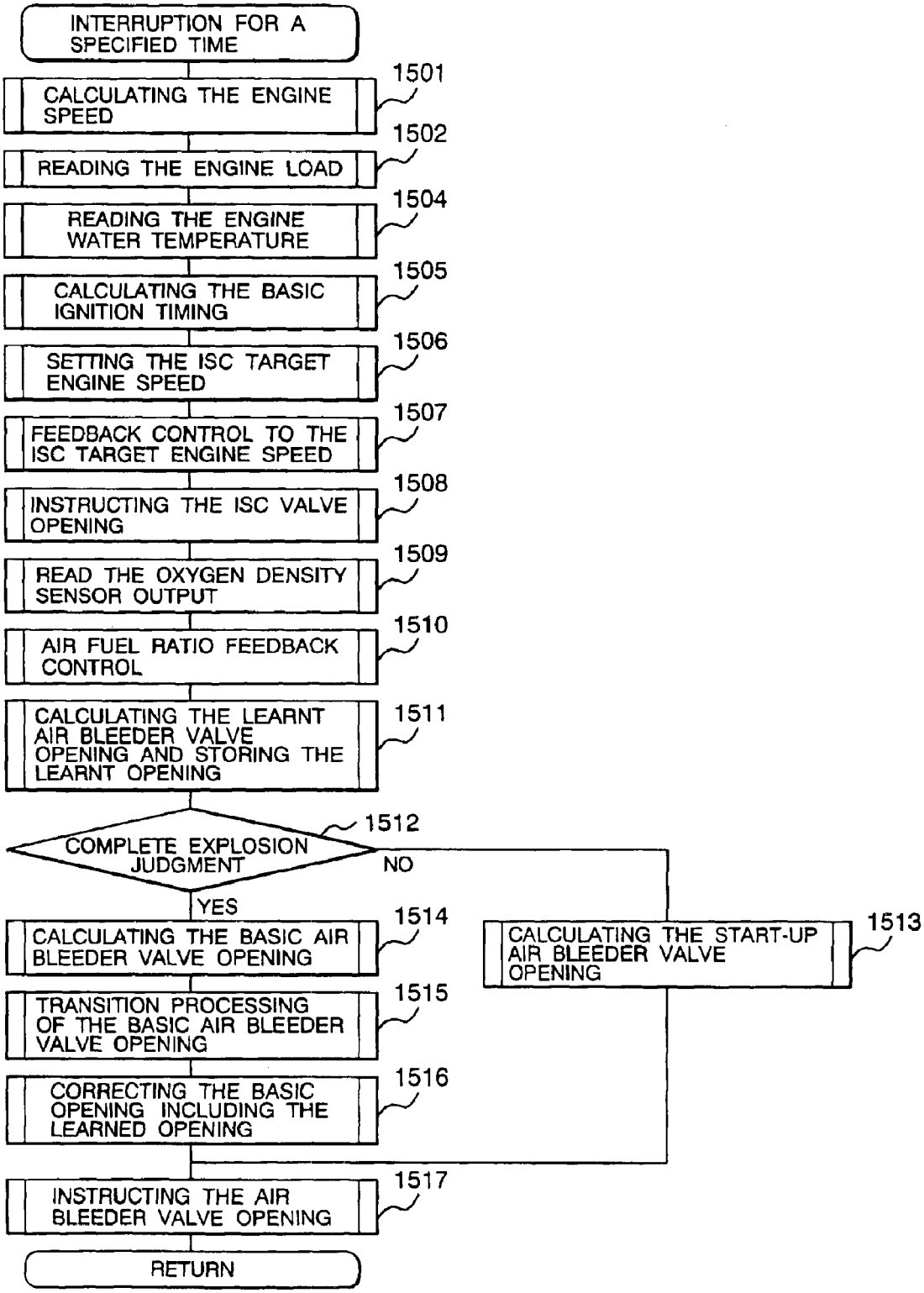
FIG. 15 is an example control flowchart of the fuel control appliance including the air-fuel ratio control method with the venturi type fuel supply device of the present invention.

FIG. 15 is an example control flowchart of a fuel control appliance including the engine air-fuel ratio control method with a venturi type fuel supply device to which the present invention applies. A block 1501 calculates the engine speed, and a block 1502 reads the engine load such as the intake pipe pressure. A block 1504 reads the engine water temperature, and a block 1505 calculates the basic ignition timing based on the engine speed, engine load and engine water temperature obtained above. A block 1506 sets the ISC target engine speed based on the obtained engine water temperature, and a block 1507 performs feedback control so that the engine speed is set to the ISC target engine speed. In a block 1508, the control variable obtained through the ISC feedback control is outputted to the ISC valve. A block 1509 reads the oxygen density sensor output, and a block 1510 performs air-fuel ratio feedback control. After the air-fuel ratio feedback control is complete, a block 1511 calculates the learnt air bleeder opening and stores (records into memory) the learnt opening, using the air-fuel feedback control variable obtained above. A block 1512 judges complete explosion or not of the engine, based for example on the engine speed. If the engine is judged not complete explosion condition, a block 1513 calculates the start-up air bleeder opening. If the engine is judged complete explosion condition in the block 1512, the blocks1514 to 1516 are processed. Block 1514 calculates the basic air bleeder opening, using the engine speed and engine load. A block 1515 performs transition processing of the basic air bleeder opening. A block 1516 corrects the basic opening learnt opening obtained from air-fuel ratio learning. A block 1517 outputs the instruction value of the air bleeder opening, calculated above, as the air bleeder opening.

Figure 16:
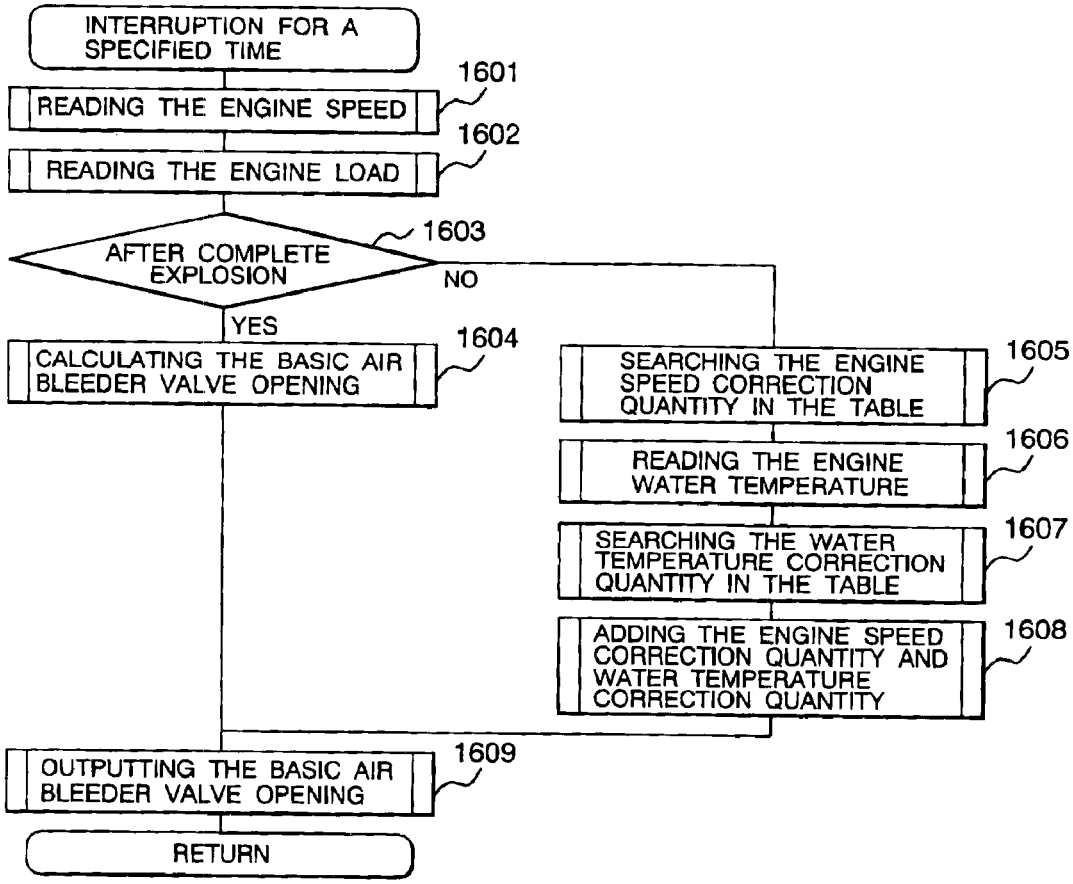
FIG. 16 is an example overall flowchart of the air bleeder opening calculation block of the present invention.

FIG. 16 is an example overall flowchart of the air bleeder opening calculation block in FIG. 5. In this embodiment, a flow chart of consecutive calculation blocks of the air bleeder opening around the start-up of the engine. A block 1601 reads the engine speed. A block 1602 reads the engine load. A block 1603 judges complete explosion or not of the engine and, if judged complete explosion condition, a block 1604 searches the basic air bleeder opening into a map. If the engine is judged not complete explosion in the block 1603, blocks 1605, 1606, 1607 and 1608 search the engine speed based correction quantity and water temperature based correction quantity into tables and add the results, and the sum of the results is the basic air bleeder opening. A block 1609 outputs the basic air bleeder opening, corresponding to the complete explosion/not complete explosion condition.

Figure 17:
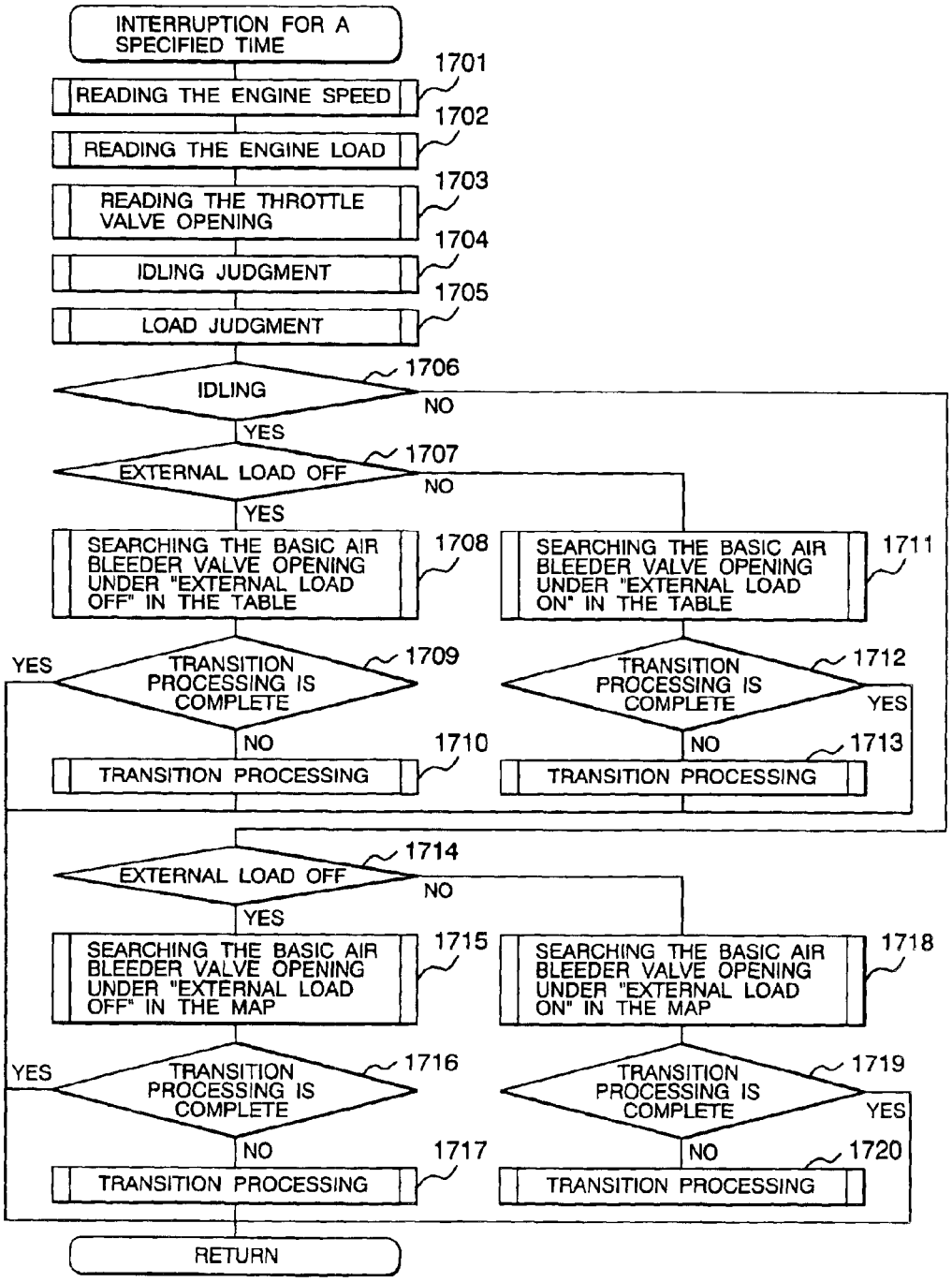
FIG. 17 is an example detailed flowchart of the calculation block of the basic air bleeder opening of the present invention.

FIG. 17 is an example detailed flowchart of the calculation block of the basic air bleeder opening. A block 1701 reads the engine speed. A block 1702 reads the engine load. A block 1703 reads the throttle opening, and a block 1704 judges idling/non-idling. A block 1705 judges external load shown in FIGS. 18 and 19, to be described later. A block 1706 judges idling/non-idling. When judged idling, blocks 1707 to 1713 are processed. The block 1707 judges whether the external load is OFF. When the external load is judged "OFF", the block 1708 searches the basic air bleeder opening under "external load OFF" into a table, using the engine water temperature. The block 1709 judges whether the transition processing is complete. If the transition processing is not complete, the block 1710 performs the transition processing. If the external load is judged "ON" in the block 1707, the blocks 1711 to 1713 are processed in a similar manner as when judged OFF. If the engine is judged "non-idling" in the block 1706, the blocks 1714 to 1720 are processed in a similar manner as when judged "idling". The basic air bleeder opening when judged "non-idling" is searched into a map, using the engine speed and engine load. In this embodiment, the transition processing is determined complete if the present air bleeder opening has reached the specified final value.

Figure 18:
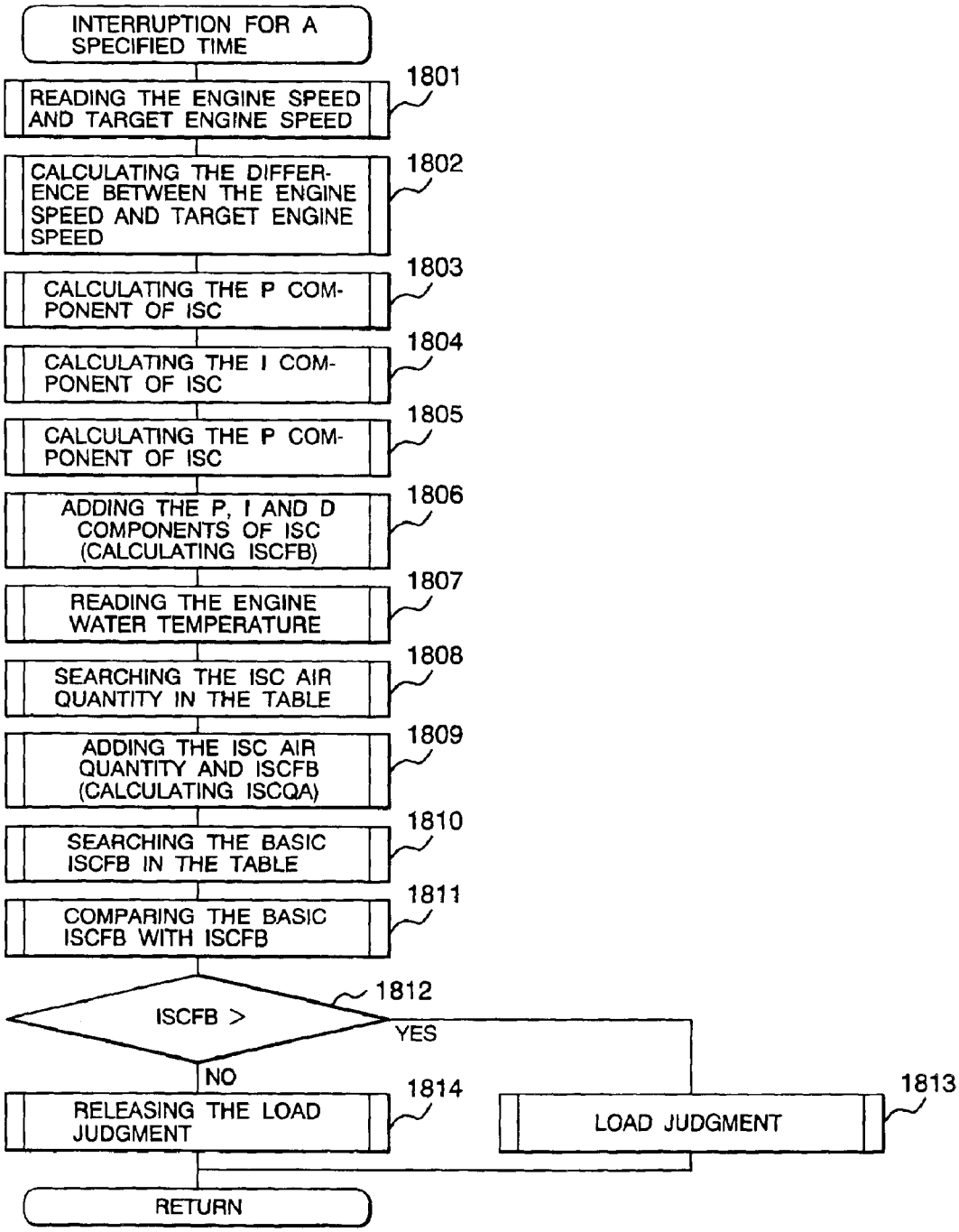
FIG. 18 is an example flowchart of the load judgment block of the present invention.

FIG. 18 is an example flowchart of the load judgment block in FIG. 7. A block 1801 reads the present engine speed and the target ISC engine speed, and a block 1802 calculates the difference between the engine speed and the target engine speed obtained above. Blocks 1803 to 1805 calculates the P, I, D components of the ISC feedback control, respectively and a block 1806 adds up them and calculates the feedback control variable ISCFB. A block 1807 reads the engine water temperature, and a block 1808 searches the ISC air quantity into a table, using the engine water temperature obtained above. The ISC air quantity searched from the table is added to the feedback control variable ISCFB in a block 1809 and the ISC opening is determined. A block 1810 searches the basic ISCFB into a table, using the engine water temperature. The basic ISCFB searched from the table is compared with the feedback control variable ISCFB in a block 1811 and a block 1812. If the feedback control variable ISCFB is greater, a block 1813 judges externally "Loaded". If the feedback control variable ISCFB is smaller, a block 1814 releases the load judgment.

Figure 19:
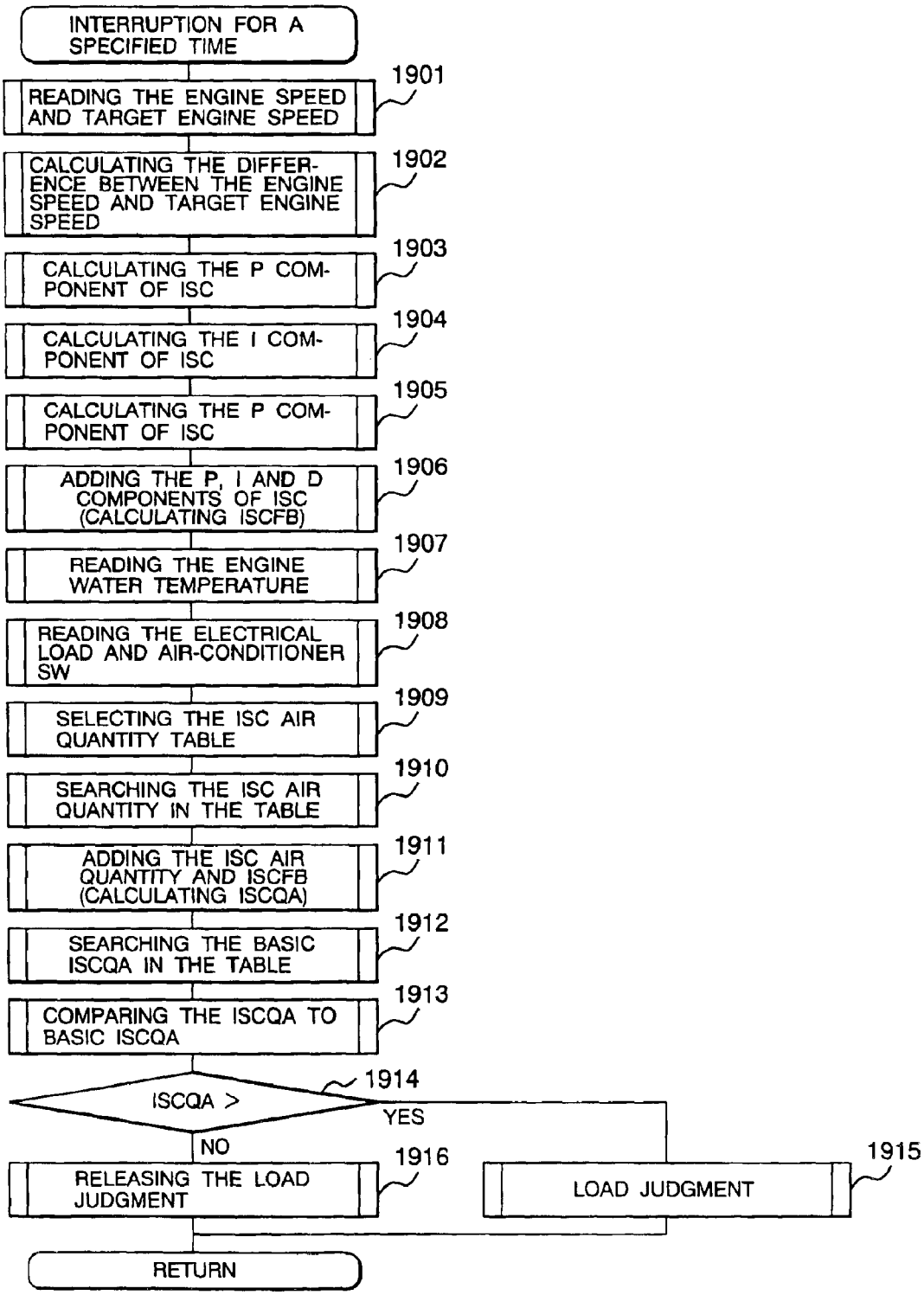
FIG. 19 is another example flowchart of the load judgment block of the present invention.

FIG. 19 is an example flowchart of the load judgment block in FIG. 8. It is almost similar to the flowchart in FIG. 18. But it differs only in a point that a block 1909 selects suitable ISC air quantity table for each load switch (air-conditioner switch, electrical switch, etc.) and that a block 1912 searches the basic ISCQA, using the engine water temperature, and compares the basic ISCQA with ISCQA (in blocks 1913 and 1914) to judge the external load.

Figure 20:
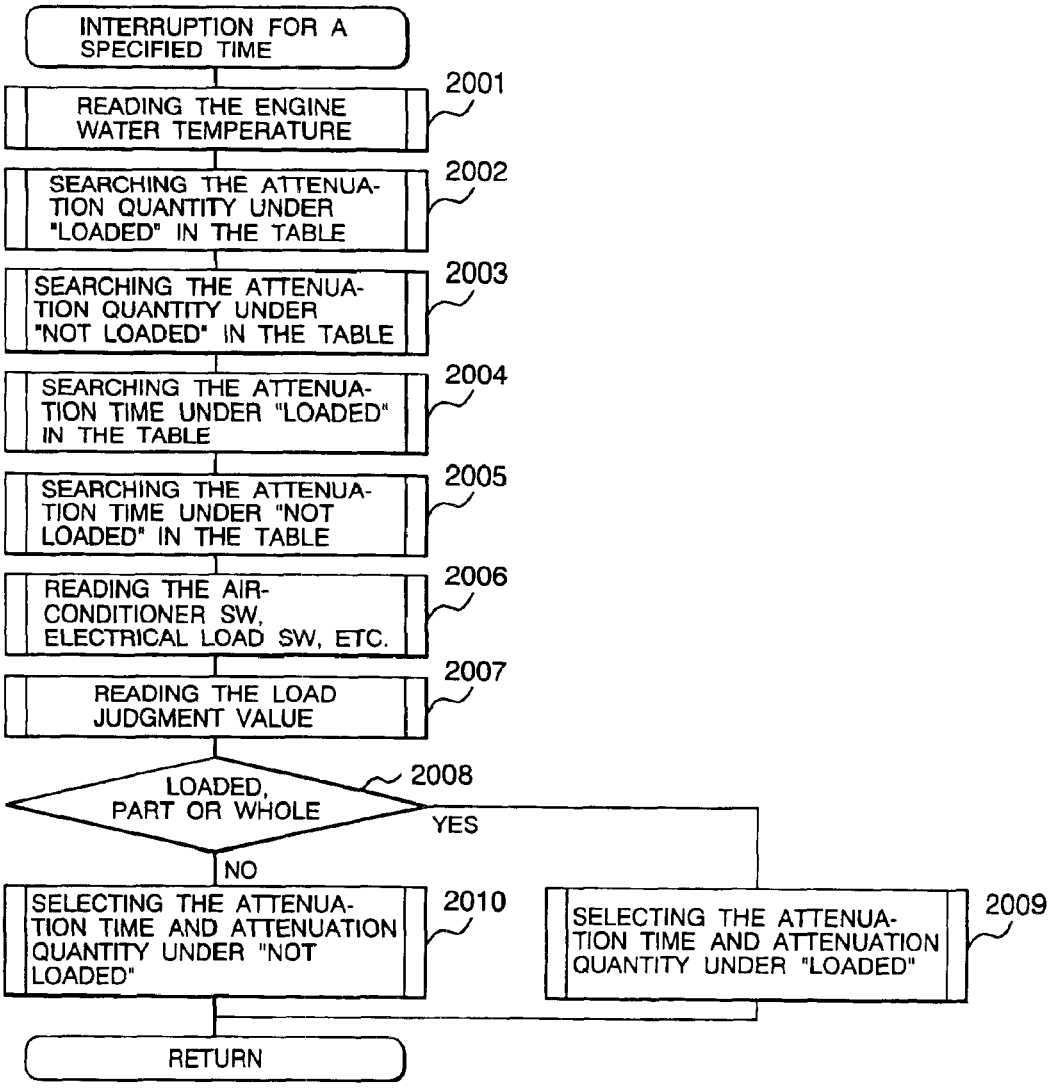
FIG. 20 is an example detailed flowchart for setting the attenuation quantity and attenuation time for the transition processing of the present invention.

FIG. 20 is an example detailed flowchart for setting the attenuation quantity and the attenuation time for the transition processing in FIG. 11. A block 2001 reads the engine water temperature. Blocks 2002 to 2005 search respective attenuation quantity and attenuation time into tables, using the engine water temperature obtained above. A block 2006 reads the air-conditioner switch, electrical load switch, etc. A block 2007 reads the external load judgment value. A block 2008 judges whether loaded by any of them and, if any, a block 2009 selects the attenuation time and the attenuation quantity under externally "Loaded". If judged no load, a block 2010 selects the attenuation time and attenuation quantity under externally "Not loaded".

(Effects of the Invention)

According to the present invention, with a venturi type fuel supply device under external load variation, the air-fuel mixture can be supplied without changing the air-fuel ratio greatly so as to maintain the engine speed corresponding to the external load variation. In a preferable mode of the invention, air-fuel ratio change corresponding to the change in the required ISC air quantity at the time of external load variation can be corrected, using the air bleeder opening. Because of this, ignition failure due to idling variation or engine speed variation resulting from the air-fuel ratio variation is not caused. Besides, because the air-fuel ratio variation can be controlled, the deterioration of exhaust gas emissions can be restrained.

In another preferable mode of the invention, the transition processing is provided so as to control the air-fuel ratio variation, and hence a driver's feeling of torque variation can be restrained. Besides, the transition processing time is set separately for each air-fuel ratio change from "rich" to "lean" and from "lean" to "rich", and hence it can cope with the control of the air-fuel ratio variation and the control of the torque variation feeling.

What is claimed is:

1. An air-fuel ratio control method of an engine with a venturi type fuel supply device comprising, at least, a venturi chamber located in the upstream of a throttle valve and a passage for supplying air-fuel mixture gas into the venturi chamber; wherein the passage is equipped with a variable air bleeder valve for taking in air, and when the operating state of an external load of the engine changes, the opening of the air bleeder valve is adjusted in accordance with the change so as to control the air-fuel mixture ratio of the mixture gas incoming from the passage into the venturi chamber two or more control variables are provided for adjusting the air bleeder valve opening in accordance with the change in the operating state of the external load, and the opening of the air bleeder valve is adjusted by switching the two or more control variables, a valve opening transition processing is provided for adjusting the air bleeder valve opening, thereby the opening is adjusted gradually, and the transition quantity and the transition time of the air bleeder valve on the occasion of switching from "there is no external load" to "there is an external load" condition are set differently from those on the occasion of switching from "there is an external load" to "there is no external load" condition.

2. An air-fuel ratio control method according to claim 1, wherein the change in the operating state of the external load is caused by switchover of an air-conditioner switch ON/OFF of a vehicle equipped with the engine.

3. An air-fuel ratio control method according to claim 1, wherein the change in the operating state of the external load is caused by a change of the electrical load of a vehicle equipped with the engine.

4. An air-fuel ratio control method of an engine with a venturi type fuel supply device comprising, at least, a venturi chamber located in the upstream of a throttle valve and a passage for supplying air-fuel mixture gas into the venturi chamber; wherein the passage is equipped with a variable air bleeder valve for taking in air, and when the operating state of an external load of the engine changes, the opening of the air bleeder valve is adjusted in accordance with the change so as to control the air-fuel mixture ratio of the mixture gas incoming from the passage into the venturi chamber, wherein the venturi type fuel supply device further comprises a bypass passage bypassing the throttle valve and a bypass valve installed in the bypass passage, the bypass valve opening is adjusted based on the operating state of the external load, and the air bleeder valve opening is adjusted in accordance with the adjustment quantity of the bypass valve opening.

5. A venturi type fuel control device, comprising, at least, a venturi chamber located in the upstream of a throttle valve of an engine, a passage for supplying air-fuel mixture gas into the venturi chamber, a variable air bleeder valve, installed in the passage, for taking in air, a detection means for detecting the operating state of the external load of the engine, a control means that obtains control variables for adjusting the air bleeder valve opening, when the operating state of the external load of the engine changed, based on the detected operating state of the external load, an air bleeder valve adjustment means for adjusting the opening of the air bleeder valve in accordance with the control variables so as to control an air-fuel ratio of the mixture gas incoming from the passage into the venturi chamber; and a bypass valve installed in the bypass passage, and a bypass valve adjustment means for adjusting the bypass valve opening based on the change of the operating state of the external load, wherein the air bleeder valve adjustment control means adjusts the air bleeder valve opening in accordance with the adjustment quantity of the bypass valve opening.

6. A venturi type fuel control appliance according to claim 5, wherein the control means obtains two or more control variables in accordance with the information from the detection means, and the air bleeder valve adjustment means operates by switching the two or more control variables.

7. An air-fuel ratio control appliance according to claim 5, wherein the detection means is a means for detecting the operating state of the air-conditioner ON/OFF switch of a vehicle equipped with the engine.

8. An air-fuel ratio control appliance according to claim 5, wherein the detection means is a means for detecting the operating state of the electrical load of a vehicle equipped with the engine.

* * * * *